United States Patent [19]

Weber

[11] Patent Number: 4,550,274

[45] Date of Patent: Oct. 29, 1985

[54] MOSFET SUSTAINER CIRCUIT FOR AN AC PLASMA DISPLAY PANEL

[75] Inventor: Larry F. Weber, Champaign, Ill.

[73] Assignee: Interstate Electronics Corporation, Anaheim, Calif.

[21] Appl. No.: 657,464

[22] Filed: Oct. 3, 1984

Related U.S. Application Data

[63] Continuation of Ser. No. 549,212, Nov. 4, 1983, abandoned, which is a continuation of Ser. No. 258,757, Apr. 29, 1981, abandoned.

[51] Int. Cl.[4] ..... H05B 37/00; G09G 3/28

[52] U.S. Cl. ..... 315/169.4; 315/169.2; 340/789; 340/752; 340/805; 307/571; 307/597

[58] Field of Search ..... 315/169.4, 169.2, 174, 315/135; 340/752, 789, 805; 307/200 B, 517, 582, 571, 597; 363/134, 133, 55, 56

[56] References Cited

U.S. PATENT DOCUMENTS

| | | | |
|---|---|---|---|
| 3,646,364 | 2/1972 | Kaminski | 307/200 B |
| 3,959,669 | 5/1976 | Peters | 315/169.4 X |
| 4,180,762 | 12/1979 | Weber | 315/169.4 |
| 4,200,822 | 4/1980 | Miller | 340/805 X |
| 4,276,487 | 6/1981 | Arzubi et al. | 307/582 |
| 4,384,287 | 5/1983 | Sakuma | 315/169.4 X |

*Primary Examiner*—David K. Moore
*Assistant Examiner*—Vincent DeLuca
*Attorney, Agent, or Firm*—Knobbe, Martens, Olson & Bear

[57] ABSTRACT

A sustainer for an AC plasma panel is disclosed, wherein two MOSFET transistors are used to alternatively, selectively provide a two level output signal which is used to maintain the emission of light from the plasma panel. The sustainer circuitry requires only a single logic input to control both transistors, and prevents both transistors from conducting simultaneously. The slew rate of the sustainer output is controlled to prevent noise generation, and circuitry is included to prevent high frequency oscillations in the transistors.

17 Claims, 4 Drawing Figures

MOSFET SUSTAINER CIRCUIT FOR AN AC PLASMA DISPLAY PANEL

This application is a continuation of application Ser. No. 549,212, filed 11/4/83, which in turn was a continuation of Ser. No. 258,757, filed 4/29/81, both now abandoned.

BACKGROUND OF THE INVENTION

AC plasma display panels are presently in commercial use as digitally addressable information display devices. The panel itself consists of two glass plates with a gas mixture sealed between them. A plurality of X-axis electrodes extend in a mutually parallel array on an interior substrate of one plate, and a plurality of Y-axis electrodes extend in a mutually parallel array on the interior of the other plate. The X-axis electrodes are at a ninety degree angle to the Y-axis electrodes, thereby forming a plurality of intersections between the X-axis and Y-axis electrodes. The typical commercially available AC plasma panel has 512 X-axis electrodes and 512 Y-axis electrodes, yielding 262,144 intersections.

When a voltage of between 180 and 200 volts is applied across an X-axis electrode and a Y-axis electrode, a discharge in the gas at the intersection between the electrodes occurs, causing a pulse of light to be emitted at the intersection of these elements. Once such discharge has been produced, it may be continuously maintained by the impression of a lesser AC sustain voltage between the electrodes, which causes the gas to emit a pulse of light at each transition of the applied AC waveform. This sustain voltage, however, is insufficient to initiate a discharge at an X-Y intersection. This phenomenon is known as inherent memory, and was originally disclosed by Baker et al in U.S. Pat. No. 3,499,167, and by Bitzer et al in U.S. Pat. No. 3,959,190. By precisely timing, shaping, and phasing multiple alternating voltage waveforms supplied to X and Y axes electrodes, the generation, sustaining, and erasure of light emitting gas discharges at selected locations on the plasma display panel can be controlled.

Prior art devices have typically used multiple level alternating voltage sustainer drive signals which are applied to both the X and Y electrodes, and present a composite sustainer waveform across the gas at each cell or point in the display panel where the X and Y electrodes intersect. Each of the X and Y electrodes in the past devices has been driven by one of the two separate complex sustainer circuits, operating typically at 95 volts. An improvement to this system was disclosed in U.S. Pat. No. 4,180,762, issued Dec. 25, 1979, to Larry Francis Weber and assigned to Interstate Electronics Corporation. This patent disclosed a means by which a single sustainer circuit is connected to one axis only of the panel electrodes, and accomplishes the sustaining function for all of the intersections in the panel.

Past systems typically required at least seven voltage levels to be supplied from the power supply, some of these levels required to be floating. These numerous voltage levels were required in order for the circuitry to generate the particular waveform required to control the generation, sustaining, and erasure of light emitting gas discharges at the selected location in the plasma display panel. Since an AC plasma display unit is generally packaged in one unit with its power supply contained within the unit, the requirement of numerous voltage levels presents the specific disadvantages of: (a) the size of the power supply; (b) difficulties in cooling the power supply; and (c) power dissipation problems within the circuitry of the display itself associated with the numerous voltage levels required. A further disadvantage of the requirement of numerous voltage levels is that such systems are costly to produce and test, and must frequently have the voltage levels adjusted.

Previous sustainer designs have also required at least two logical inputs, one input controlling the high output level of the sustainer, and the second input controlling the low output level of the sustainer. If these inputs do not have the proper phase relationship to each other, serious damage could occcur to the sustainer circuit, generally resulting in the destruction of part or all of the sustainer circuitry.

SUMMARY OF THE INVENTION

The present invention relates to the use of Metal Oxide Semiconductor Field Effect Transistor (MOSFET) devices in a sustainer circuit used to drive an AC plasma panel. The MOSFET sustainer circuit may be utilized in the interface and control circuitry for an AC plasma panel without requiring extensive changes to the existing circuit. There are four functions that are used to operate an AC plasma panel: the write function, the erase function, the sustain function, and the bulk-erase function. The write function causes a pip of light to be written on the screen at a chosen location. Operation of the sustain function makes the location where a pip of light was previously written continue to emit light, since the plasma panel has an inherent memory. The erase function, when operated, will cause the location, activated by the write signal, to stop emitting light; that is, it will erase the inherent memory of the panel. The bulk-erase function will cause the entire panel to stop emitting light by erasing the inherent memory of the panel in one operation.

Operation of the different functions in the AC plasma panel is controlled by four pulse trains: an X-Sustain Signal, a Y-Sustain Signal, an X-Address Pulse, and a Y-Address Pulse. The X-Sustain Signal and the Y-Sustain Signal are fed to every location on the panel, and operate on the entire panel to cause all locations which have been written and no erased to continue to be sustained; that is, to continue to use the inherent memory of the plasma panel. The X-Address Pulse and the Y-Address Pulse are used to perform the write, erase, and bulk-erase operations and for write and erase operations are sent only to locations on the panel where a write or erase function is being carried out. For bulk-erase the entire panel is erased in one operation, so the pulses are sent to all locations on the panel. The direction of X-Address Pulses and Y-Address Pulses to desired areas on the plasma panel is carried out by addressing circuitry existing in the control circuitry and known in past devices.

The present invention uses two high voltage-high current MOSFET transistors to supply the sustainer voltage waveform, which is a simple rectangular wave which requires no additional shaping or pedestals for any of the operating modes. One of the transistors is connected to a high voltage power supply $V_{CC2}$, and the second transistor is connected to ground. The two transistors have a common connection, which is the output of the circuit. When a MOSFET transistor is turned on, it acts like a switch to connect the common node with either $V_{CC2}$ or ground, depending on which transistor is turned on. The circuitry of the sustainer controls the two MOSFETs, so that only one of them can be turned on at a time. Therefore, when the transistor connected to $V_{CC2}$ is turned on, it will charge the plasma panel to high voltage, and when the transistor connected to ground is turned on, it will discharge the panel back to zero volts.

The input to the sustainer circuit is a single open collector TTL logic gate. Therefore, only a single input to the circuit is required, in contrast to past systems which require two inputs, one controlling each of the two transistors. The only power source which the sustainer circuit requires, other than the high voltage $V_{CC2}$ which is being switched, is a single 12-volt, ground based supply voltage. Since the sustainer of this invention needs only to produce a simple rectangular wave, there is no need to produce intermediate voltage levels, such as were required by prior systems, to produce complex pedestal-shaped waveforms.

Since only the single 12-volt DC power supply is needed to bias the sustainer circuitry, the number of required power supply voltages is greatly reduced. As a result, the present invention simplifies the manufacturing, testing, packaging, and cooling of the electronic circuitry associated with the power supplies and the sustainer and driver circuits.

Since the sustainer waveform is a simple rectangular wave, only a single logical input is necessary to drive the sustainer circuit. Since only one logic input signal is being used, which is either high or low, the possibility for improper phasing of the two MOSFET transistors in the sustainer, which could result in the destruction of at least one of the transistors, is completely eliminated. Despite the fact that only a single logic input is used, there are no limitations imposed by this type of system on the logic timing.

The use of MOSFET transistors in this circuit eliminates the classic thermal runaway problem that all bipolar sustainer designs have had in the past. MOSFETs do not exhibit the storage time phenomena, which is a significant delay between the time an input is supplied to the transistor and the time at which the transistor supplies an output. Because MOSFETs do not exhibit storage time phenomena, the switching delays are extremely short. This feature, and the fact that the circuitry of the sustainer will prevent both transistors from being turned on at the same time, assure that excess power, which was required to be dissipated in prior sustainer designs, is no longer present, so power dissipation for the transistors is no longer a significant problem. The present sustainer is designed so that the output voltage has a maximum slew rate, or rate at which the voltage level will rise to its peak or fall to zero, that is independent of the logic input timing. Therefore, excessive displacement currents that could cause noise which could mis-trigger the lower voltage logic signals are avoided. This slew rate limit also minimizes the sustainer overshoot on the rise and fall of the sustainer waveform.

BRIEF DESCRIPTION OF THE DRAWINGS

These and other advantages of the present invention are best understood through reference to the drawings, in which.

DESCRIPTION OF THE PREFERRED EMBODIMENT

Figure 1:
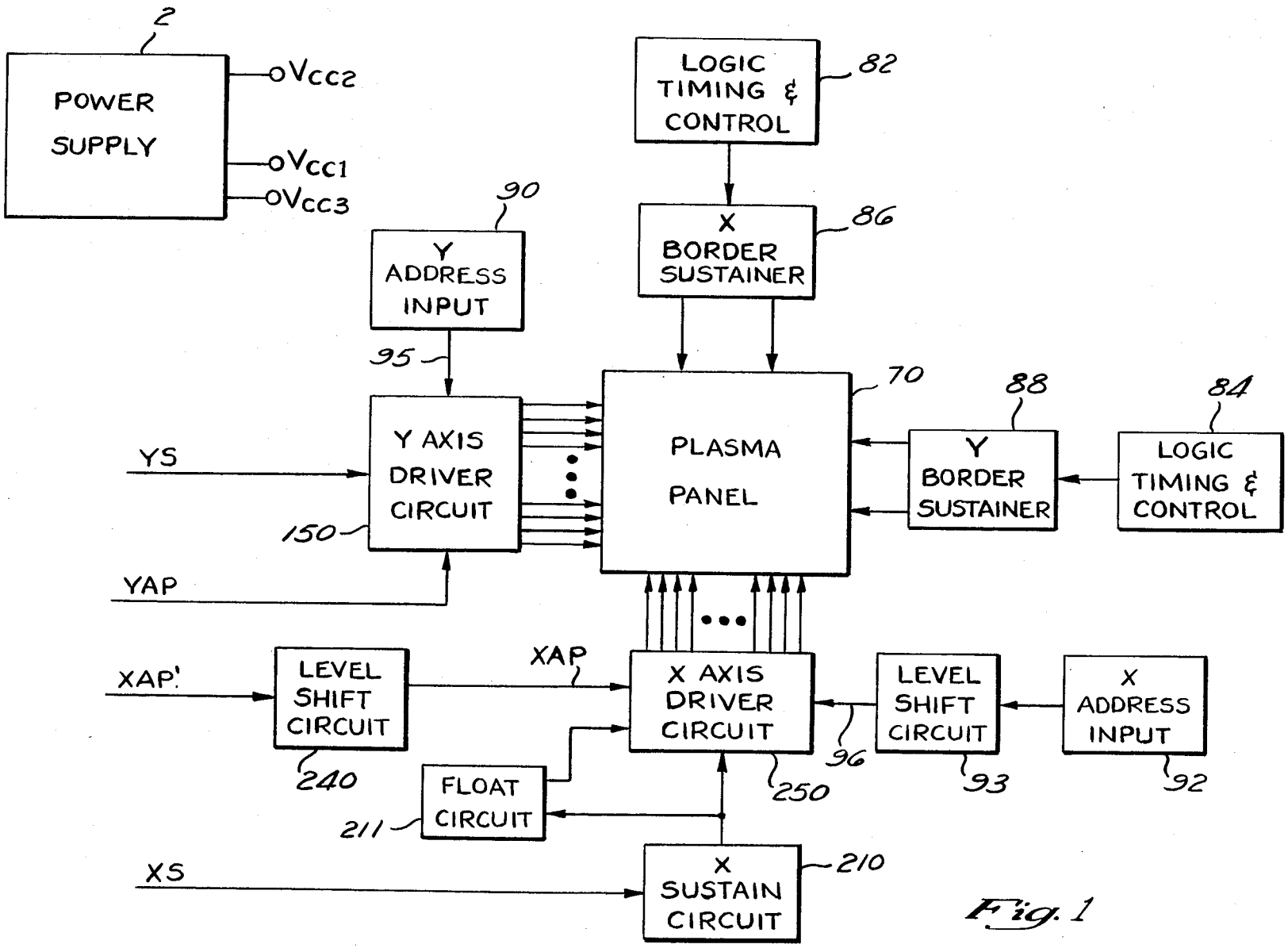
FIG. 1 is a block diagram of the overall system for driving an AC plasma panel in accordance with the present invention.

FIG. 1 shows the present invention as implemented in the circuitry for controlling a plasma panel 70. A power supply 2 supplies three levels of voltage: $V_{CC2}$, which is typically 90 to 100 volts; $V_{CC1}$, typically 12 volts for CMOS logic; and $V_{CC3}$, which is typically 5 volts for TTL logic.

The plasma panel 70 is typically a 512 by 512 AC gas plasma panel, and is available commercially. A 512 by 512 panel has X and Y electrodes which form a matrix, which is composed of 512 X-axis electrodes and 512 Y-axis electrodes. These electrodes cross to form 262,144 intersection points or cells which are independently addressable to allow the display of two-dimensional information on the panel. The X-axis has a plurality of X addresses, with each X electrode being associated with an X address. The Y-axis has a plurality of Y addresses, with each Y electrode being associated with a Y address.

Figure 2:
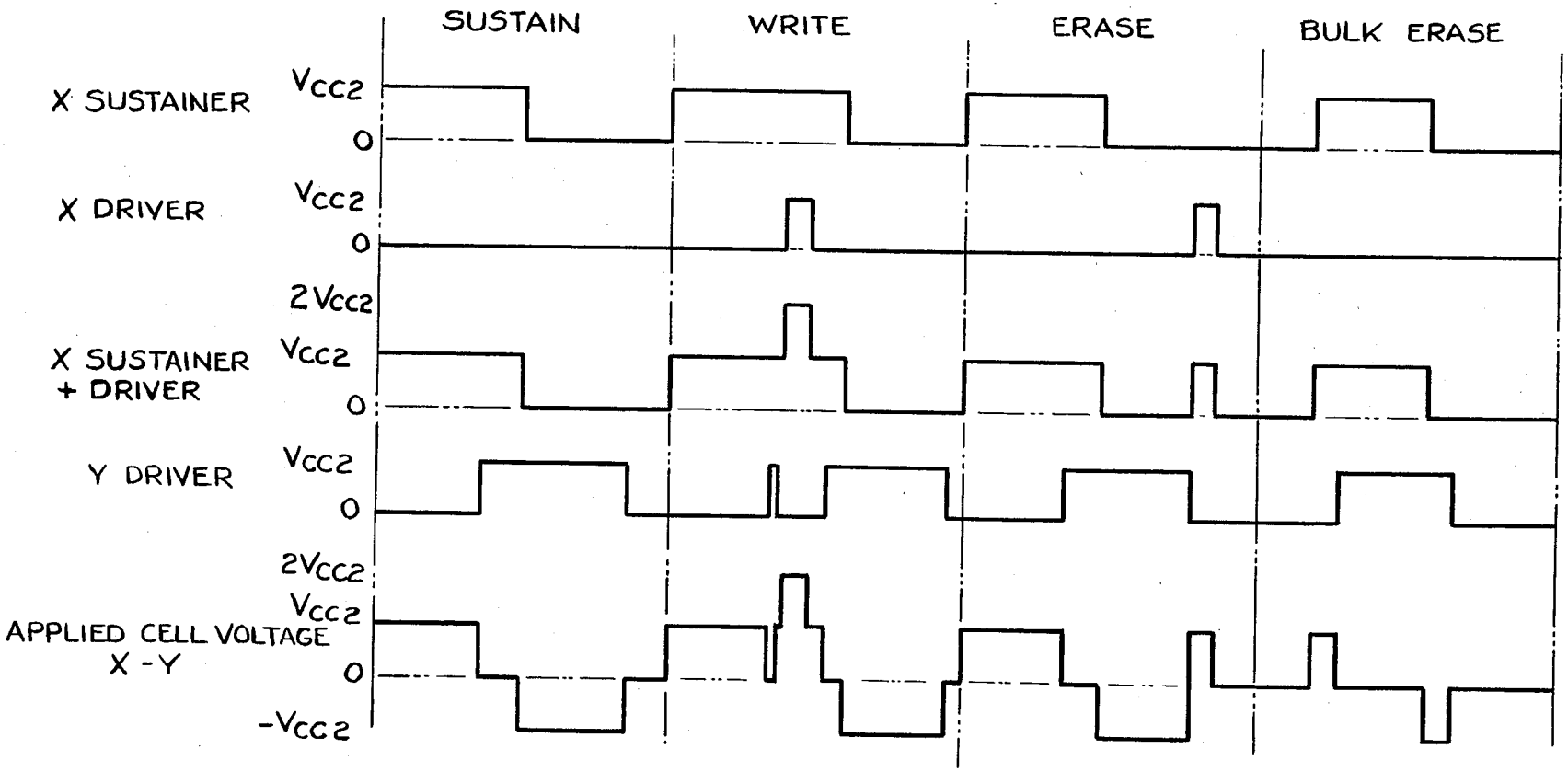
FIG. 2 illustrates the waveforms generated by the X-sustainer, the X-electrode driver, the combination waveform generated by the X-sustainer and the X-electrode driver, the waveform generated by the Y-electrode driver, and the applied cell voltage X-Y.

In the operation of an AC plasma panel, there are four types of control function waveforms which are applied to the intersecting X and Y electrodes to perform an operation. These four functions are sustain, write, erase, and bulk-erase, and are shown in FIG. 2. The waveform which is applied to the X-axis electrodes is X Sustainer+Driver. The X Sustainer waveform shown in FIG. 2 is formed by an X sustain circuit 210. The X Sustainer+Driver waveform is the output of the X axis driver circuit 250 in FIG. 1, and is the summation of the waveform generated by the X sustain circuit 210 and a waveform generated internally by the X axis drive circuit 250. The Y electrodes are supplied with the waveform shown in FIG. 2 as Y Driver. The composite of each of the waveforms, which will be seen across the cell or intersection point between driven X and Y electrodes, is the applied cell voltage X−Y, shown in FIG. 2.

Unless one of the other three functions is being applied to address a given cell, the sustain waveform is constantly applied to all electrodes of the plasma panel. Whenever a write or erase function is being applied to the panel, that function will be applied only to selected cells in which a write or erase operation is to be performed. The rest of the panel will have a sustaintype waveform applied to it, so that all cells which have been written will continue to emit light. As can be seen best in the applied cell voltage X−Y waveform of FIG. 2, a write operation is accomplished by placing a high voltage level across the intersection of the cell which is to be written. This large voltage will turn the cell on, so that, whenever sustain waveform is later applied to the cell, it will emit light. The erase function is sed on selected cells to turn them off, so that, when the sustain waveform is later applied, they will not emit light. The bulk-erase function is used when it is desired to erase the entire panel in one operation.

The phenomenon whereby a cell will continue to emit light when stimulated by the sustain waveform after being written is known as storage or inherent memory. The use of inherent memory in a plasma panel is advantageous because the use of large external hardware memory is not required. As long as the AC sustaining voltage is applied to the panel, selected locations which have previously been written continue to emit light without further addressing. As can be seen from the applied cell voltage X−Y waveform of FIG. 2, the level of the AC voltage needed to sustain is $V_{CC2}$, and the level which is needed to write is 2 $V_{CC2}$.

FIG. 1 shows a block diagram of the circuitry for operating the plasma panel 70. Except for the X sustain circuit 210, this circuit has been described in U.S. Pat. No. 4,180,762, to Larry F. Weber, and in copending application Ser. No. 412,205, filed Aug. 27, 1982, which is a continuation of application Ser. No. 166,579, filed July 7, 1980, now abandoned by Joseph T. Suste. Both inventions have been assigned to the present assignee, and both specifications are hereby incorporated herein by reference. The present invention was first disclosed in the Suste application.

A computer and control circuitry standard in the art are used to supply the circuit shown in FIG. 1 with information describing the operations to be performed, and the locations to be addressed. For the X-axis, this information includes an inverse X-Address Pulse XAP', and an X-Sustain XS Signal, both of which are configured to implement one of the four functions of the panel. The X-Address Input 92 is supplied to the circuit to define which locations on the X-axis will be addressed.

Information supplied to the circuit to control operations on the Y-axis include the Y-Sustain YS Signal and the Y-Address Pulse YAP, both of which are configured to implement one of the four basic functions of the panel. The circuitry which is used to supply the YS, YAP, XAP', and XS pulse trains, and the address location information (Y Address Input 90 and X Address Input 92), is of the same type as that used by past systems to control an AC plasma planel.

The circuitry for exciting any one of the plurality of intersections of the X-axis and Y-axis electrodes is provided by an X-axis driver circuit 250 and a Y-axis driver circuit 150, respectively connected to the X-axis electrodes and the Y-axis electrodes. The Y-axis driver circuit performs both the drive and sustain functions for the Y-axis. It supplies the Y Driver waveform shown in FIG. 2 to the Y-axis electrodes. The Y-axis driver is controlled by the Y-Sustain YS Signal and the Y-Address Pulse YAP. The locations to which the write and erase pulses are supplied is controlled by the Y-Address Input 90.

The X-axis circuitry is somewhat more complex because it has a separate X-sustain circuit 210 and X-axis driver circuit 250. The X-axis driver circuit 250 is not ground based; it is based on a floating ground and driven by floating inputs, provided by the level shift circuits 93 and 240, which supply the X-axis circuit 250 with the location to be addressed from the X-Address Input 92, and the X-Address Pulse XAP, respectively. The level shift circuit 240 is an inverting circuit, and thus provides the Signal XAP in response to the inverse X-Address Pulse XAP'.

The X-Sustain XS Signal is supplied to the X-sustain circuit 210 which is the subject of the present invention. The output of the X-sustain circuit 210 becomes a floating ground upon which the X-axis driver circuit 250 is based. A float circuit 211 is used to supply two floating levels of power to the X-axis driver circuit 250.

The nature of the plasma panel is such that sustain voltages must be applied to the panel borders as a means for priming the plasma cells so that the panel may be reliably written. This priming produces free electrons and gas ions which enable a write operation to be carried on with complete accuracy. An X-border sustainer circuit 86 is connected to the X-axis borders, and a Y-border sustainer circuit 88 is connected to the Y-axis borders. The X-border sustainer circuit 86 and the Y-border sustainer circuit 88 are driven by pulse trains generated by logic timing and control circuits 82 and 84, respectively.

Figures 3, 3A:
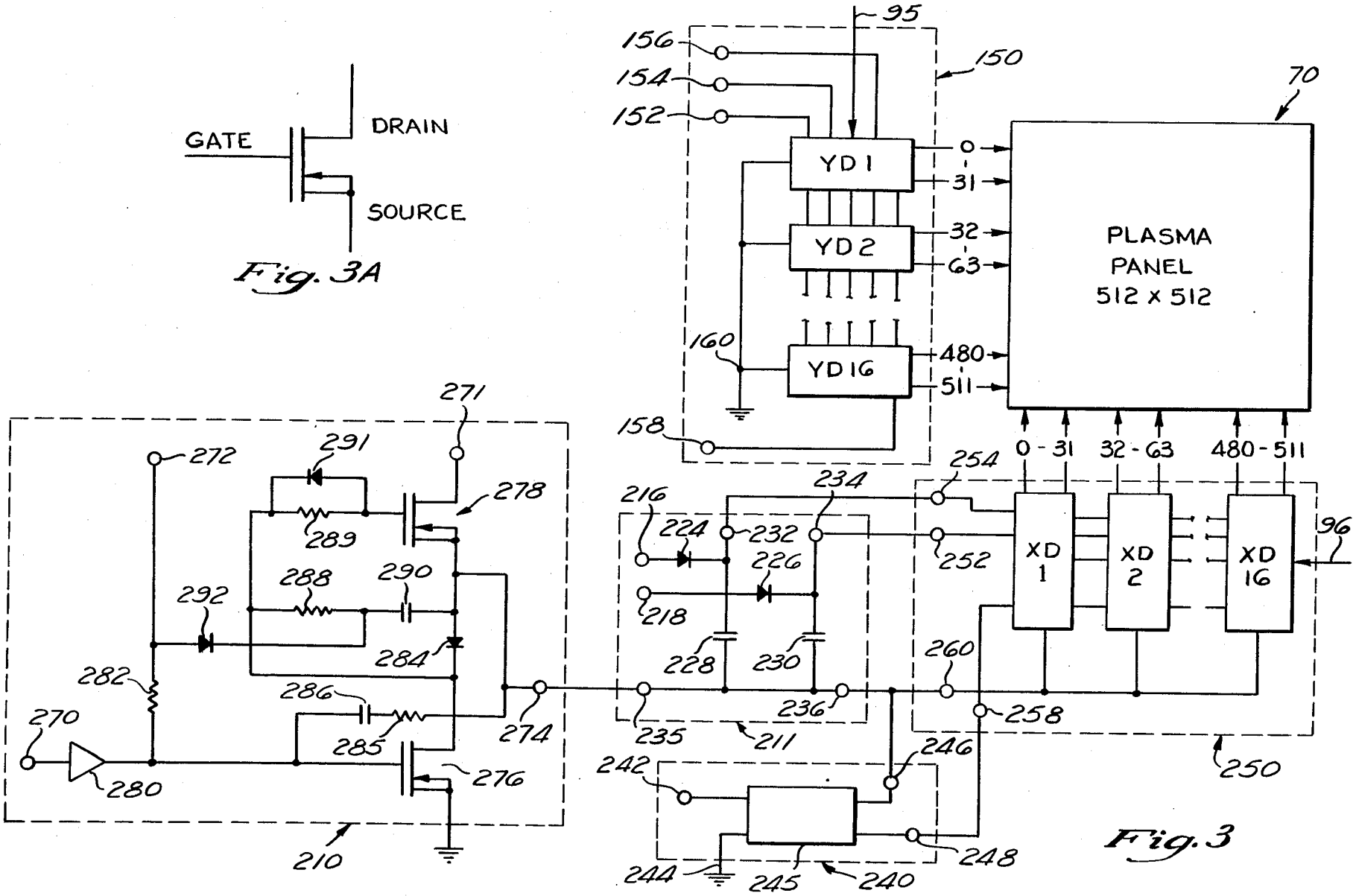
FIG. 3 is a schematic diagram of the sustainer and driver circuitry using the MOSFET sustainer circuit of the present invention.
FIG. 3A is a symbolic representation of a MOSFET transistor showing the output leads.

The X-sustainer circuit 210, which is the subject of the present specification, is shown in FIG. 3, wherein the elements of FIG. 1 are enclosed by dotted lines. $V_{CC2}$ is supplied to terminals 152, 218, and 271, which are power supply points for the Y-axis driver circuit 150, the float circuit 211, and the X-sustain circuit 210, respectively. $V_{CC1}$ is supplied to terminals 154, 216, and 272, which are low voltage power supplies for the Y-axis driver circuit 150, the float circuit 211, and the X-sustain circuit 210, respectively. The Y-Sustain YS Signal is supplied to terminal 156, the Y-Address Pulse YAP is supplied to terminal 158, the inverse X-Address Pulse XAP' is supplied to terminal 242, and the X-Sustain XS Signal is supplied to terminal 270. X and Y addres information is supplied to the circuit on lines 96 and 95, respectively.

The X-axis driver chips XD1–XD16 are SN75500 integrated circuit chips, and the Y-axis drivers YD-1–YD16 are SN75501 integrated circuit chips, manufactured by Texas Instruments. The X-level shift circuitry 240, which is used to obtain a floating X-Address Pulse XAP, is a common level shift circuit known in the past, and generally inverts the signal.

The float circuit 211 is used to supply the X-driver chips XD1–XD16 with floating levels of power supply $V_{CC1}$ and $V_{CC2}$. A diode 226 and capacitor 230 will supply a floating $V_{CC2}$ at terminal 234 with reference to terminal 236, which is then supplied to the X-driver chips XD1–XD16 at terminals 252 and 260. The flowing $V_{CC1}$ is supplied by the use of a diode 224 and a capacitor 228, which supplies a floating $V_{CC1}$ at terminal 232 with respect to terminal 236, and is supplied to the X-driver chips XD1–XD16 at terminals 254 and 260. The X-sustain circuit 210 has an output 274 which is supplied to the float circuit 211 at point 235. This output 274 from the sustainer circuitry becomes the floating ground for the X-driver chips, XD1–XD16.

The X-sustainer circuit 210, shown in FIG. 3, includes two high-voltage-high-current MOSFET transistors 278 and 276 which are connected in a totem-pole manner, that is the pull-up transistor 278 is connected to high voltage at point 271, and the pull-down transistor 276 is connected to ground, with a common connection 274 serving as the output. The pull-up transistor 278 is used to charge the plasma panel to voltage $V_{CC2}$, the pull-down transistor 276 is used to discharge the panel to zero volts. Both transistors 278 and 276 are N-channel enhancement type MOSFETs, the connections to which are shown in FIG. 3A as a gate, a drain, and a source. Whenever the gate of a MOSFET is at a high potential with respect to the source, the transistor will conduct, connecting the drain and the source so that it operates as a closed circuit. The gates of the transistors 278 and 276 are driven by a single open collector TTL logic gate 280, such as an SN7417 or an SN7416.

The X-sustain circuit 210 requires only a single, low voltage, ground based power supply, connected at terminal 272. It is significant that no other power supplies are used. A further feature of the present invention is that only one logic input signal is needed, that signal being input to the circuit at terminal 270. With the signal logic input at 270 in the present device, there is no possibility for improper phasing, since only one of the transistors can be turned on at a time. This prohibits simultaneous conduction through both of the transistors 276 and 278, which would conduct high voltage directly to ground through the transistors, and possible failure of at least one of the transistors 276, 278.

The use of MOSFET transistors in this design eliminates the classic thermal runaway problem that all bipolar sustainer devices have had in the past. Bipolar transistors usually have an increased storage time whenever the temperature of the transistors has increased. This increased storage time, which is the time between the application of an input to the transistor and the time when the transistor supplies the desired output, may cause both the upper and lower transistors to conduct at the same time. This will result in excess power which must be dissipated by the transistors, which will cause a further increase in temperature. This condition will eventually result in thermal runaway of the transistors, and may result in the destruction of at least one of the transistors. This undesirable positive feedback characteristic is absent in MOSFET transistors, which do not exhibit storage time phenomena and have very short switching delays.

OPERATION OF THE MOSFET SUSTAINER CIRCUIT

The gate of the pull-down transistor 276 is driven by the open collector TTL logic gate 280 and biased by the resistor 282. When the open collector output transistor of the logic gate 280 is non-conductive, the resistor 282 will pull the gate of the pull-down transistor 276 to the level $V_{CC1}$, which will cause the pull-down transistor 276 to conduct. Conduction through pull-down transistor 276 will pull the sustainer output 274 to ground potential through a diode 284.

It is desirable that, when either of the transistors 276 or 278 is turned on, the output at terminal 274 not rise or fall too rapidly, since a rapid rise and fall could result in excessive displacement currents, causing noise that could possibly mis-trigger low voltage logic signals of the system, particularly those in the driver chips. Therefore, the substainer of the present invention has an output voltage at terminal 274 which has a maximum slew rate independent of logic input timing. This slew rate limit also minimizes the sustainer overshoot on the rise and fall of the sustainer output.

A capacitor 286 and a resistor 282 control the fall time slew rate of the sustainer output 274. Thus, as the sustainer output falls, it forces displacement current through the capacitor 286 and the resistor 285. Since most of this current must flow through the resistor 282, as the output falls, the voltage drop across the resistor 282 causes considerably less than the value of $V_{CC1}$ to be provided at the gate of the pull-down transistor 276. During this output fall, the gate of the pull-down transistor 276 is typically at a constant level of 5 volts. This constant 5 volt level causes the transistor 276 to act as a constant current source, so that the plasma panel 70 is discharged with a constant current, which results in a linearly decreasing ramp voltage. Since a linearly decreasing ramp voltage will also cause constant displacement current to flow through the capacitor 286, which condition is necessary for the constant 5 volts at the gate of the transistor 276, the constant displacement current is maintained by the ramp voltage which is creates.

Thus, the characteristics of the pull-down transistor 276 and the values of the resistor 282 and the capacitor 286 determine the slew rate of the falling output voltage.

The state of the pull-up transistor 278 is controlled by the action of the pull-down transistor 276. When the pull-down transistor 276 conducts, a diode 284 is forward biased. Since the diode 284 has a voltage drop of typically 0.6 volts, the gate of the pull-up transistor 278 will be pulled down through a diode 291 to a voltage which is more negative than the source of the pull-up transistor 278. The diode 291 conducts to bypass a resistor 289 to prevent delay in pulling down the gate of the pull-up transistor 278. If the resistor 289 is not bypassed, the pull-up transistor 278 could conduct for a short time after the pull-down transistor 276 begins to conduct, possibly causing adverse power dissipation.

Because the pull-up transistor 278 has a very fast switching time, e.g., 5 ns, it is biased so that it will stop conducting almost as soon as the pull-down transistor 276 conducts, so that the transistors 276 and 278 may not both conduit at the same time. This quick turnoff is of substantial significance in reducing the power dissipated in the transistors 276 and 278.

While the pull-down transistor 276 is conducting, a capacitor 290 is charged to a level of approximately 11 volts by the power supply $V_{CC1}$ at terminal 272 through a diode 292. The capacitor 290 displacement current flows through the diode 284 and the pull-down transistor 276 to ground. When the output of the logic gate 280 goes to a low level and turns the pull-down transistor 276 off, the diode 284 is immediately back-biased by the charge on the capacitor 290. The gate of the pull-up transistor 278 is then biased positive relative to the voltage at its source by the resistors 288 and 289 and the capacitor 290, causing the pull-up transistor 278 to conduct.

When the pull-up transistor 278 is turned on, the only paths provided for discharge of the capacitor 290 is the leakage currents through the diodes 284 and 292, the gate of the pull-up transistor 278, and the drain of the pull-down transistor 276. This current amounts to no more than a few microamps. Therefore, the capacitor 290 acts as a floating power supply for the gate of the pull-up transistor 278, holding the gate at a constant voltage level. Th capacitor 290 will remain charged for a period much longer than the conductive period of the pull-up transistor 278 for normal sustain operation.

The greatest amount of charge drawn from the capacitor 290 is drawn when the pull-down transistor 276 first becomes non-conductive and the pull-up transistor 278 first becomes conductive, since, at this time, the capacitor 290 charges the gate capacitance of the pull-up transistor 278 and the drain capacitance of the pull-down transistor 276. The value of the capacitor 290 is selected so that it is considerably higher than the sum of these two capacitances. A typical value of 10 microfarads for the capacitor 290 has been found to be much larger than is necessary to satisfy these current supply needs.

When the pull-up transistor 278 is turned on, it is controlled in a way that limits the slew rate of the voltage output 274 to a linear rising ramp. This rate of rising is controlled by the resistor 288, the source-to-drain capacitance of the pull-down transistor 276, the voltage across the capacitor 290, and the characteristics of the pull-up transistor 278. When the pull-down transistor 276 is turned off, the gate of the pull-up transistor 278 is pulled high by the resistor 288 and the capacitor 290, as stated earlier, so that the gate is at a voltage level which is somewhat higher than that present at its source. This will cause a constant current to flow out of the source of the pull-up transistor 278, which will charge up the plasma panel at a constant rate. Some of this current will also flow through the capacitor 290 and the resistor 288, charging the drain-to-source capacitance of the pull-down transistor 276. Since this capacitance is charged entirely by the current that flows through the resistor 288, it is apparent that if the output of the sustainer rises too fast, the voltage across the drain of the pull-down transistor 276 will not rise as fast. The gate-to-source voltage of the pull-up transistor 278 will be reduced, causing the current from the source of the pull-up transistor 278 to also be reduced and thereby preventing the output of the sustainer from rising too rapidly. A similar situation occurs if the sustainer output rises too slowly, but in that case, the gate-to-source voltage of the pull-up transistor 278 will increase to compensate.

Therefore, it can be seen that when a switching operation occurs, the transistor which is turning off will turn off immediately. The transistor which is turning on is controlled so that the voltage at the sustainer output 274 will either rise or fall in a linear ramp function, thus preventing current surges and resulting noise from interfering with the performance of the system.

A possible problem with any feedback-type circuit using MOSFET transistors is that there may be oscillations when the sustainer is in transition between the high and low states. These oscillations are very high frequency, too high to adversely affect the response of the plasma panel, but at a frequency which may cause excessive power dissipation in the MOSFET transistors. The circuit shown in FIG. 3 includes a feedback circuit used to eliminate these oscillations by limiting the slew rate of the sustainer circuitry.

This circuit includes a feedback resistor 289 in the gate lead of the pull-up transistor 278. Since the resistor 289 would slow the response of the pull-up transistor 278 when its gate is pulled down, it is bypassed by a diode 291. The diode 291 will bypass the resistor 289 only when the pull-down transistor 276 is turned on. The diode 291 is a low capacitance diode to prevent high frequency oscillations from causing the resistor 289 to be bypassed.

The pull-down transistor 276 may also oscillate unless protective circuitry is provided. A resistor 285 is connected in series with the capacitor 286 to prevent oscillations in the pull-down transistor 276. The combination of the resistors 285 and 289 and the diode 291 prevents the transistors 276 and 278 from oscillating without otherwise affecting system performance.

It can therefore be seen from the above discussion that the present invention provides a number of distinct advantages over the prior art. The sustainer circuitry of this invention significantly reduces circuit complexity, power dissipation, and the number of supply voltages necessary. Additional features of the invention include the requirement of only a single logic input signal, which eliminates the possibility for improper phasing of the transistors, which could result in the destruction of at least one of the transistors. The use of MOSFET transistors eliminates the classic thermal runaway problem present in all bipolar sustainer designs in the past, since MOSFET transistors are able to switch much faster than other types of transistors. Finally, since the output voltage of this sustainer design has a maximum slew rate that is independent of the logic input signal, excessive displacement currents that could cause noise to mis-trigger low voltage logic signals in the system are avoided. The maximum slew rate also minimizes sustainer overshoot in the rise and fall of the sustainer output waveform.

What is claimed:

1. A sustainer for an AC plasma panel, said sustainer comprising:

a pull-up switch connected to a first voltage potential;

a pull-down switch connected to a second voltage potential, said second voltage potential lower than said first voltage potential;

an output for said sustainer, said output coupled to said pull-up switch and driven to said first voltage potential when said pull-up switch is conductive, said output additionally coupled to said pull-down switch and driven to said second voltage potential when said pull-down switch is conductive;

driving means for selectively, alternatively closing said pull-up and pull-down switches;

connecting means for connecting said driving means to said pull-up and pull-down switches to prevent both of said switches from being closed simultaneously; and first control means reduce the rate at which is potential of said sustainer output changes from said first potential to said second potential to a rate effective to eliminate excessive displacement currents;

wherein said pull-up and pull-down switches are MOSFET transistors.

2. A sustainer for an AC plasma panel, said sustainer comprising:

a pull-up switch comprising a MOSFET transistor connected to a first voltage potential;

a pull-down switch comprising a MOSFET transistor connected to a second voltage potential, said second voltage potential lower than said first voltage potential;

an output for said sustainer, said output coupled to said pull-up switch and driven to said first voltage potential when said pull-up switch is conductive, said output additionally coupled to said pull-down switch and driven to said second voltage potential when said pull-down switch is conductive;

driving means for selectively, alternatively closing said pull-up and pull-down switches;

connecting means for connecting said driving means to said pull-up and pull-down switches to prevent both of said switches from being closed simultaneously;

first control means to control the rate at which the potential of said sustainer output changes from said first potential to said second potential; and means coupled to said pull-up and pull-down switches for preventing high frequency oscillations in said pull-up and pull-down MOSFET transistors when they are alternatively closed.

3. A sustainer for an AC plasma panel as defined in claim 2, wherein said preventing means comprises a resistor in series with the gate of one of said MOSFET transistors.

4. A sustainer for an AC plasma panel as defined in claim 3, wherein said resistor is in series with the gate of said pull-up transistor, said preventing means additionally comprising:

5. A sustainer for an AC plasma panel as defined in claim 1, additionally comprising a second control means to reduce the rate at which the potential of said sustainer output changes from said second potential to said first potential to a rate effective to eliminate excessive displacement currents.

6. A sustainer for an AC plasma panel as defined in claim 5, wherein said first and second rate control means cause said sustainer output potential to change linearly.

7. A sustainer for an AC plasma panel as defined in claim 1, wherein said driving means opens said pull-up switch whenever said pull-down switch begins to close, and closes said pull-up switch only when said pull-down switch is open.

8. A sustainer for an AC plasma panel, said sustainer comprising:

a pull-up MOSFET transistor connected to a high voltage potential;

a pull-down MOSFET transistor connected to a ground potential;

an output for said sustainer alternatively driven by said pull-up transistor and said pull-down transistor;

means coupled to said pull-up and pull-down transistors for selectively driving said pull-up and pull-down transistors, said means preventing said pull-up transistor from conducting when said pull-down transistor is conducting; and means coupled to said pull-up and pull-down transistors for preventing high frequency oscillations in said pull-up and pull-down transistors.

9. A sustainer for an AC plasma panel as defined in claim 8, further comprising:

means for controlling the rate at which said sustainer output may be driven by said pull-up transistor and said pull-down transistor.

10. An AC plasma panel, comprising:

a plasma panel having a gas sealed between two parallel plates;

a plurality of electrodes deposited on said plates, the electrodes on one plate intersecting the electrodes on the other plate to define a plurality of cells of gas;

means for generating a sustainer signal to maintain discharges in said panel between said electrodes once said discharge has been initiated, said sustainer signal alternating between two potentials, wherein one of said potentials is higher than the other of said potentials, and wherein said means for generating said sustainer signal comprises a pair of MOSFET transistors; and means for controlling the rate at which said sustainer signal slews between said two potentials to a rate which is effective to eliminate excessive displacement currents.

11. An AC plasma panel as defined in claim 10 wherein said rate control means causes said sustainer signal to slew linearly.

12. An AC plasma panel, comprising:

a plasma panel having a gas sealed between two parallel plates;

a plurality of electrodes deposited on said plates, the electrodes on one plate intersecting the electrodes on the other plate to define a plurality of cells of gas;

means for generating a sustainer signal to maintain discharges in said panel between said electrodes once said discharge has been initiated, said sustainer signal alternating between two potentials, said generating means including output MOSFET transistors; and means for preventing high frequency oscillations in said output MOSFET transistors of said generating means.

13. A method of sustaining a light-emitting state in an AC plasma panel having a gas sealed between two parallel plates, comprising:

generating an alternating potential using a pair of output MOSFET transistors;

controlling the rate at which said potential changes from one potential level to the other to maintain the rate at an amount effective to eliminate excessive displacement currents;

impressing said alternating potential on a plurality of electrodes deposited on said plates; and preventing high-frequency oscillations during said generating step.

14. A sustainer for an AC plasma panel, said sustainer comprising:

a pull-up switch connected to a first voltage potential;

a pull-down switch connected to a second voltage potential;

an output for said sustainer, said output coupled to said pull-up switch and driven to said first voltage potential when said pull-up switch is conductive, said output additionally coupled to said pull-down switch and driven to said second voltage potential when said pull-down switch is conductive;

driving means for selectively, alternatively closing said pull-up and pull-down switches;

means coupled to said pull-up and pull-down switches for preventing high frequency oscillations in said pull-up and pull-down transistors when said transistors are alternatively closed; and wherein said pull-up and pull-down switches are MOSFET transistors.

15. A sustainer for an AC plasma panel as defined in claim 14, wherein said preventing means comprises a resistor in series with the gate of said pull-up switch.

16. A sustainer for an AC plasma panel as defined in claim 15, wherein said preventing means additionally comprises a bypass diode connected in parallel with said resistor, said bypass diode shunting said resistor when said pull-down transistor is closed to enable said pull-up transistor to be opened by said driving means.

17. A sustainer for an AC plasma panel as defined in claim 15, wherein said preventing means additionally comprises a resistor connected in series between said output and the gate of said pull-down transistor.

* * * * *